United States Patent [19]

Shultz et al.

[11] 4,418,907

[45] Dec. 6, 1983

[54] AUTOMATIC RELOADER-ELEVATOR FOR CUT SHEET PRINTING APPARATUS

[75] Inventors: Richard E. Shultz, Maitland; William E. Voecks, Jr., Winter Park, both of Fla.

[73] Assignee: Burroughs Corporation, Orlando, Fla.

[21] Appl. No.: 302,953

[22] Filed: Sep. 16, 1981

[51] Int. Cl.[3] ..... B65H 1/26; B65H 1/14

[52] U.S. Cl. ..... 271/157; 221/11; 271/126; 271/155; 414/117

[58] Field of Search ..... 271/154, 155, 157, 158, 271/159, 160, 126; 221/11; 414/117

[56] References Cited

U.S. PATENT DOCUMENTS

| | | | |
|---|---|---|---|
| 677,062 | 6/1901 | Combs | 271/160 X |
| 899,133 | 9/1908 | Ranz | 271/160 X |
| 2,950,107 | 8/1960 | Royer | 271/158 X |
| 3,477,324 | 11/1969 | Schwebel | 271/159 X |
| 4,052,051 | 10/1977 | Mersereau et al. | 271/159 X |

*Primary Examiner*—Robert B. Reeves
*Assistant Examiner*—David F. Hubbuch
*Attorney, Agent, or Firm*—Carl Fissell, Jr.; Kevin R. Peterson; David Rasmussen

[57] ABSTRACT

Modular automatic paper handling apparatus wherein a vertically movable paper item tray is incrementally elevatable into a paper feeding position adjacent a feeding device. A cable drive including an electromagnetic impulse clutch and solenoid escapement provide control for elevating the item tray. A pivotally movable reload tray is adapted to be positioned over the main item tray such that finger-like projections integral therewith are interfitted with upstanding projections on the main item tray enabling the main item tray to be raised into a position to automatically unload paper from the reload tray after which the reload tray is automatically snapped out of the way of the main item tray. A cable counter weight permits the main tray to retract downwardly to feeding position without overrunning or bouncing.

7 Claims, 17 Drawing Figures

| FIG.10A. | FIG.10B. |
|---|---|
| | |

AUTOMATIC RELOADER-ELEVATOR FOR CUT SHEET PRINTING APPARATUS

BACKGROUND OF THE INVENTION

1. Field of the Invention

The present invention relates to paper/document handling apparatus and more particularly to an automatic paper document reloader/elevator apparatus for cut sheet printing.

2. Description of the Prior Art

Paper handling is generally considered to be one of the more difficult problems associated with the printing art. This is mainly due to the nature of the material; the flimsy, relatively unstable construction and the fact that when stacked in fairly large bundles the feeding of a single sheet is difficult to control.

In addition to the foregoing when a stack of sheets is exhausted or depleted the problems associated with reloading the stack become very involved. Usually, it requires that the apparatus be stopped or shut down i.e. "turned off", after which a fresh stack of material may then be loaded into the apparatus for resumption of feeding, printing, copying, and etc. In any case, any stoppage is time consuming and requires the attendance of an operator to detect the "empty" status of the feeding device. Since reloading cannot be performed "on the fly" certain down time of the machine is to be expected. This is inefficient and requires that the operator be on standby condition in order to "anticipate" the termination of feeding and thus be available to reload a fresh supply of material into the apparatus.

BRIEF SUMMARY OF THE INVENTION

The present invention is an automatic item stack elevator-reloader apparatus that incorporates a spring loaded, counter balanced, elevator tray with a reciprocably movable pivoted slide tray effective to continuously reload paper from a paper/document feeder employed with a printing/copying apparatus. A drive mechanism is utilized to elevate the paper stack to a pivotal paper feed head of the type described and claimed in co-pending U.S. patent application U.S. Ser. No. 240,898 filed Mar. 5, 1981 entitled PIVOTAL FEED HEAD FOR PRINTING APPARATUS in the names of Richard E. Shultz and William F. Voecks, Jr. now abandoned in favor of Continuation-In-Part U.S. Ser. No. 481,036.

A novel cable drum and cable arrangement is utilized to raise and lower the counter balanced elevator tray in measured proportion to the amount (number of sheets) of paper being handled by the apparatus. The pivoted slide tray inter-engageable with the elevator tray enables "on the fly" reloading of paper while the main elevator tray is being elevated as the supply of paper is being depleted. When the elevator tray reaches its upper most limit it elevates the reloaded paper stack off the slide tray unlatching the slide tray which is snapped backwardly out of the way of the elevator tray permitting the latter to descend to its home or start position for continuous feeding of paper.

DESCRIPTION OF A PREFERRED EMBODIMENT

Figure 1:
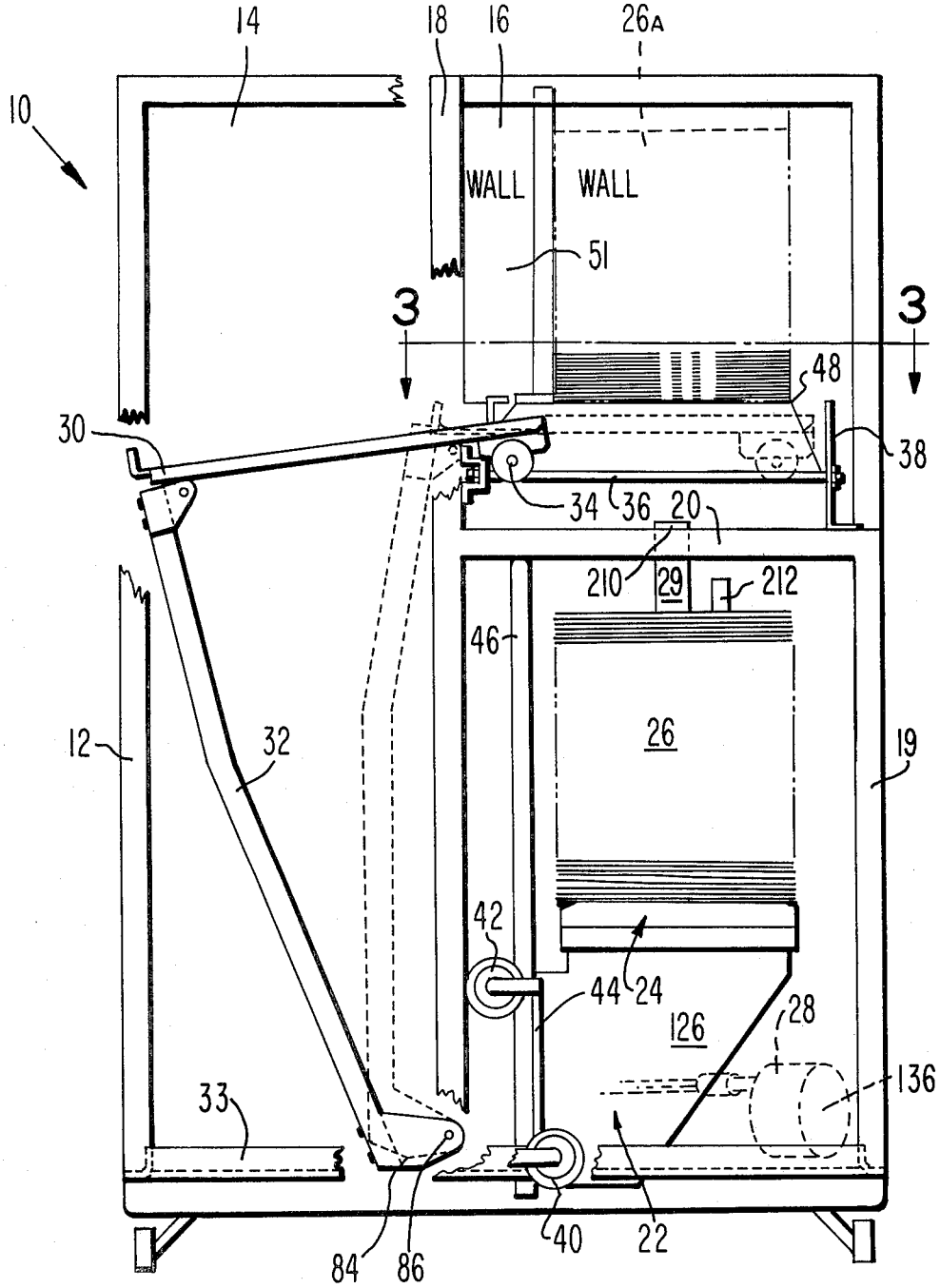
FIG. 1 is a side elevational view, with portions broken away to expose operational features, of apparatus incorporating the present invention.

The automatic reloader-elevator 10 of the present invention is seen in FIG. 1 to comprise a rigid skeletal frame 12 of substantially rectangular outline configuration, the longer dimension being in the vertical plane. The structure of FIG. 1 is adapted for demountable engagement with a utilization device, such for example, as a printer/copier apparatus.

The structure 10 is divided for the sake of simplicity of fabrication into two sections 14 and 16, separated by a rigid vertical strut or pillar 18. A horizontal member 20 joins the right side vertical support 19 to the center vertical member 18 forming a horizontal platform, for purposes to be described shortly.

As viewed in FIG. 1, the right hand portion 16 of the reloader-elevator apparatus 10 is seen to include an elevator mechanism 22 (at the bottom) for vertical "up and down" movement of a main item tray 24 carrying sheet items 26 which may comprise stacked sheets of paper for printing. Drive means 28, as will be described later on herein, enables the main tray 24 to be incrementally moved upwardly and downwardly as individual sheet items 26 are fed by feeding means 29 to an operably associated printing device not shown.

The left hand portion 14 of the reloader-elevator 10 is seen in FIG. 1 to include a reloader tray 30 hingedly mounted to a vertically disposed, irregularly shaped or bent post or pillar 32 pivoted at its lower end to the lower horizontal cross frame 33 in a manner and for a purpose which will become clear as the present description proceeds. The upper portion of the reloader tray 30 provides a platform for the reload of additional stacked items 26*a*. Tray 30 is normally moved from the left most unloaded position to the right most operational position as necessary during the operation of the apparatus.

The forward (rightward) end of tray 30 carries a supporting roller 34 adapted to move along a horizontally disposed guide rail 36, the latter being secured at its opposite ends to the central pillar 18 and an inboard vertical wall member 38, respectively.

The main item tray 24 is vertically, movably guided by means of two oppositely disposed pulley wheels 40 and 42 (at bottom) secured to a frame 44 and rotatable vertically up and down along a vertical tubular guide rail member 46, enabling the tray to be raised and lowered so as to carry the sheet items into position for feeding to a printing/copying device not shown.

Figure 2:
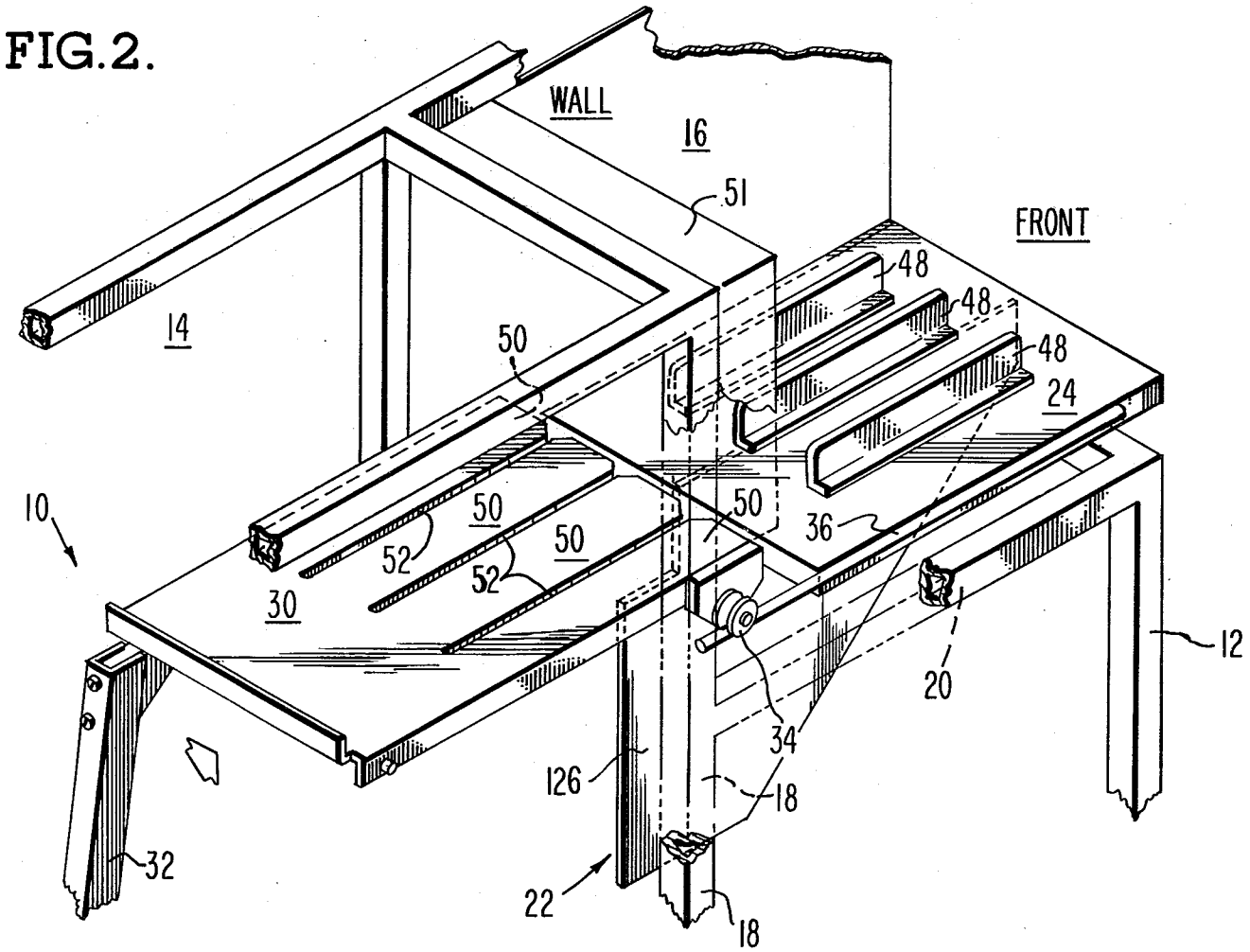
FIG. 2 is a partial schematic isometric view of the apparatus of FIG. 1 illustrating the slotted surface of the slide tray engageable with the upstanding ridges or ledges of the elevator tray of the present invention.

One of the important features of the present invention is that the operator is able to reload the apparatus without having to stop the machine. This is accomplished by means of the lockable reload tray 30. In order to enable the main tray 24 to complete the feeding operation without interruption by the reloading operation, the main tray 24, as seen most clearly in FIG. 2, is provided with a series of parallel, offset, raised lands or upstanding vertical projections 48. The reload tray 30 is notched to provide a plurality of finger-like members 50, each of the notches 52 being adapted to receive a respective individual projection 48 when the reload tray 30 is moved (rightwardly in FIG. 2) over the main tray 24 with the main tray in its "full up" or reload position, as will be explained more fully hereinafter.

Figure 3:
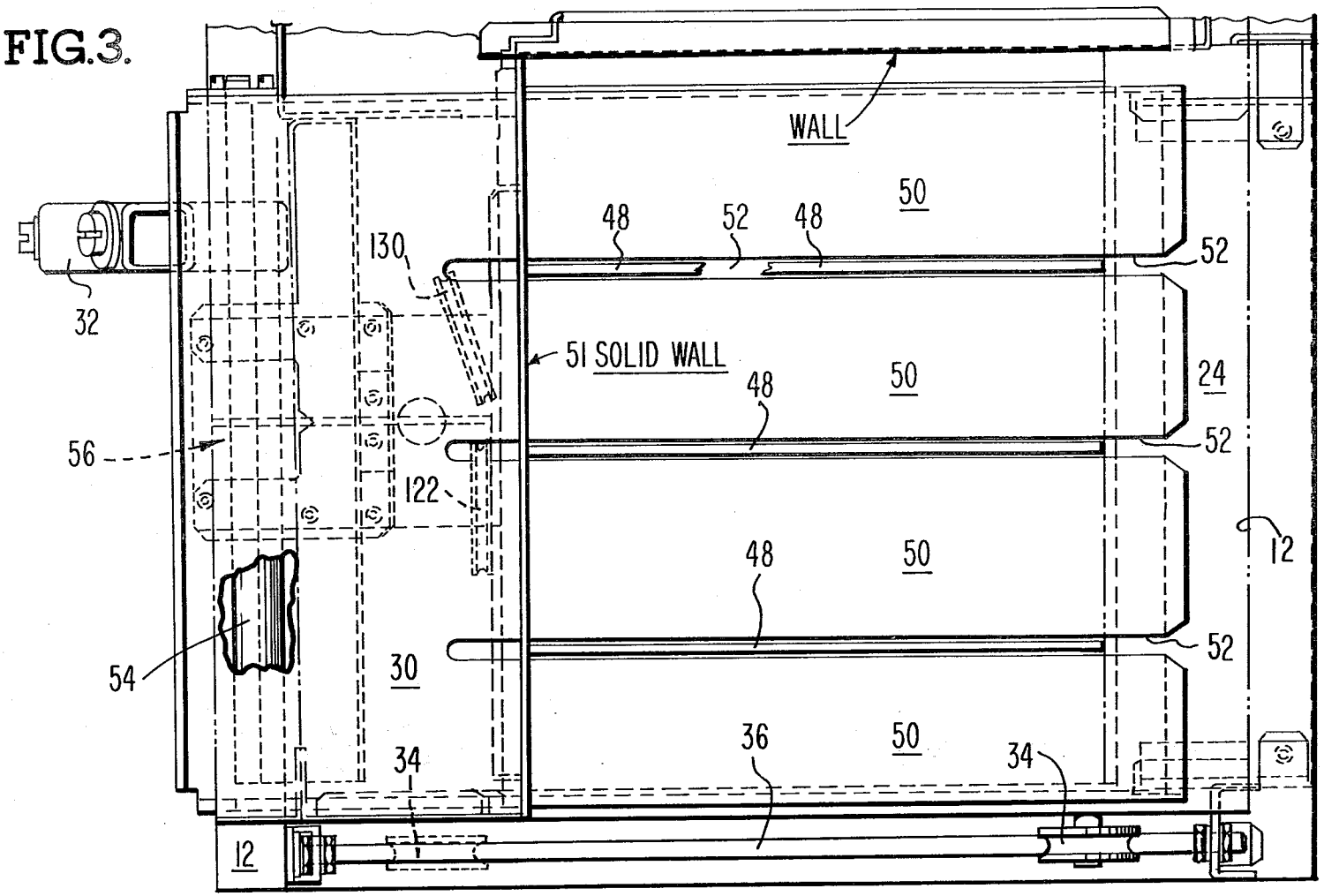
FIG. 3 is a view along the line 3—3 of FIG. 1 with the slide tray latched into place over the elevator tray.

A top plan view of the interleaving arrangement of the fingers 50 with the projections or lands 48 is shown in FIG. 3. Note that as seen in FIG. 1 the upstanding projections 48 of the main tray 24 extend upwardly a substantial distance through the slots in between the fingers 50 of the reload tray 30 when the latter is in the rightward operational position, dotted outline FIG. 1.

Figure 4:
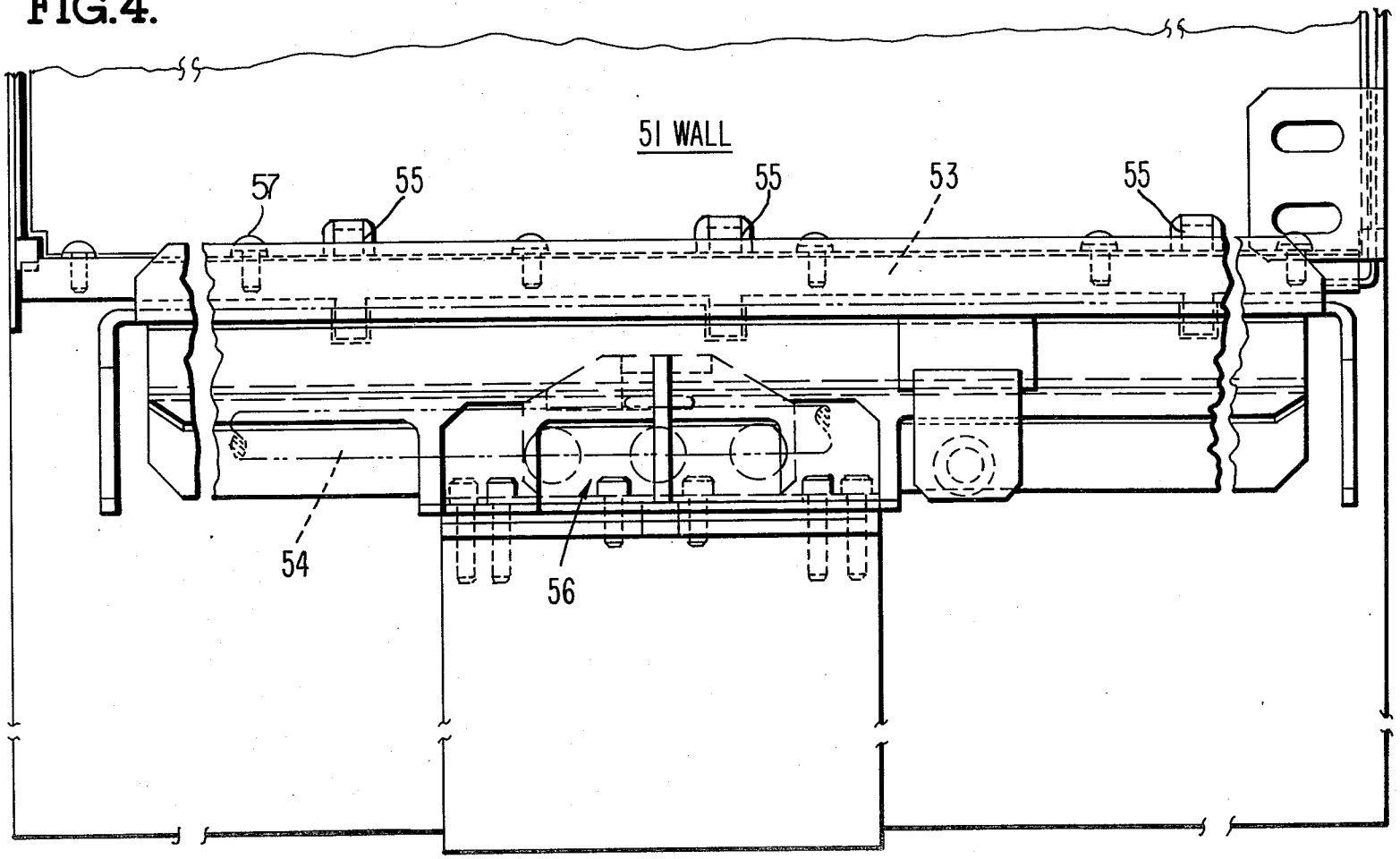
FIG. 4 is a rear view of the latching structure of the slide tray with portions broken away.

Since the reloader-elevator 10 of the present invention is reloaded by the operator from the front of the machine—right side as viewed in FIG. 1—provision has been made to prevent sheet items 26 from accidentally slipping or sliding leftwardly FIG. 1 back under the bottom of wall member 51 and onto the reload tray. Guard member 53 (FIG. 4), of light weight material e.g. Nylon, Delrin etc. provided with upper and lower oppositely disposed pairs of projections 55 integral therewith is secured as by bolts 57 to flanges on the lower edge of wall member 51. The upper projections are received in notches in wall 51 which the lower projections are received in the forward ends of the notches 52 in reload tray 30 effectively preventing paper items 26 from reaching tray 30.

The upper rear (rightward in FIG. 5) end of reload tray 30 is provided with a latch pin or rod 54 (also seen in FIGS. 3 and 4) extending from side to side thereof. A rockably pivoted latch mechanism 56 is arcuately pivoted about pivot 58 and is provided in its forward (rightward) end with a sharply angled or tapered surface portion 60 abruptly, rearwardly terminating in a fairly deep J-shaped curved notch 62 into which the crossbar or rod 54 is movably receivable. The opposite end 64 of latch link 56 is loosely secured to the vertically disposed latch return spring assembly 66. Assembly 66 includes an irregularly shaped bracket 68 secured to the main frame by means of the angle tab 70 and bolt 72. A compression spring 74 captivated at its lower end by the tab 76 and at its upper end by the angled portion 78 of bracket 68 provides tension adjustment for the latch link 56 by means of the nuts 80 adjustably movable along the threaded portion of the vertically extending shaft 82.

Figure 6:
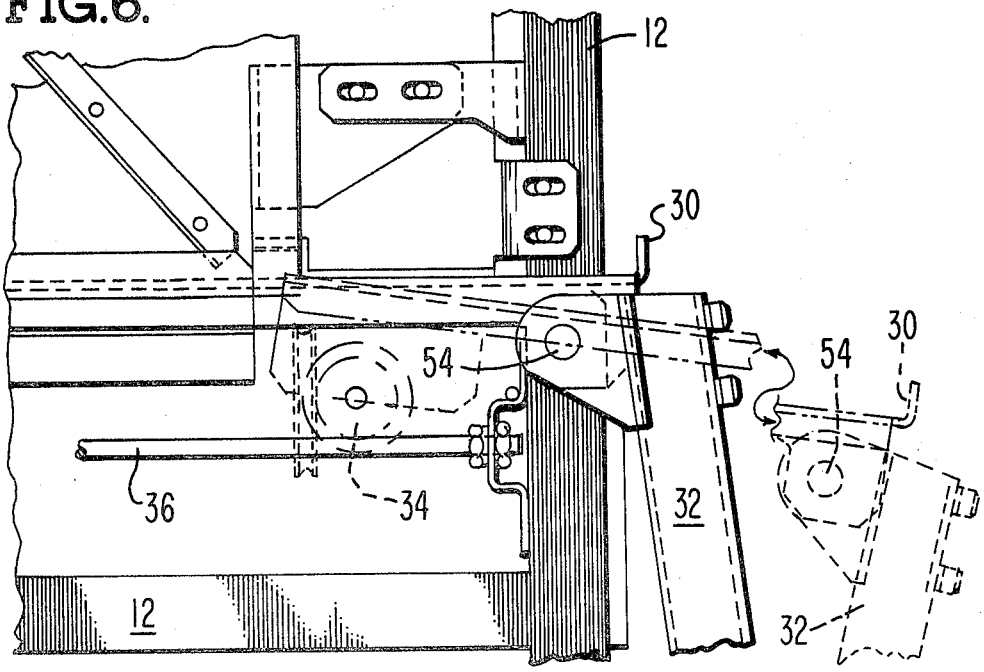
FIG. 6 is a detail side view illustrating the latch carrying pivot at the top of the pivot shaft carrying the slide tray.
Figure 7:
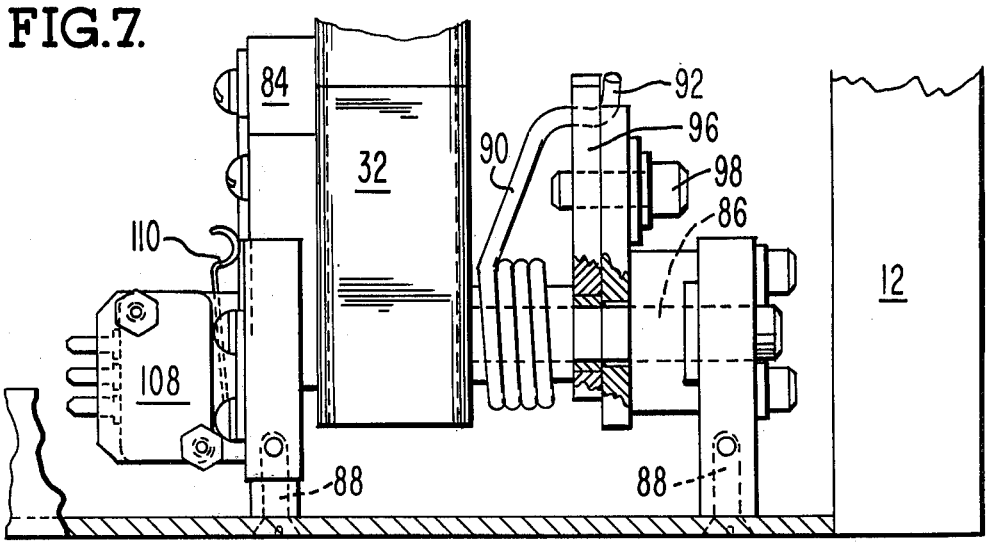
FIG. 7 is a detail view of the slide tray pivot return spring mechanism.
Figure 8:
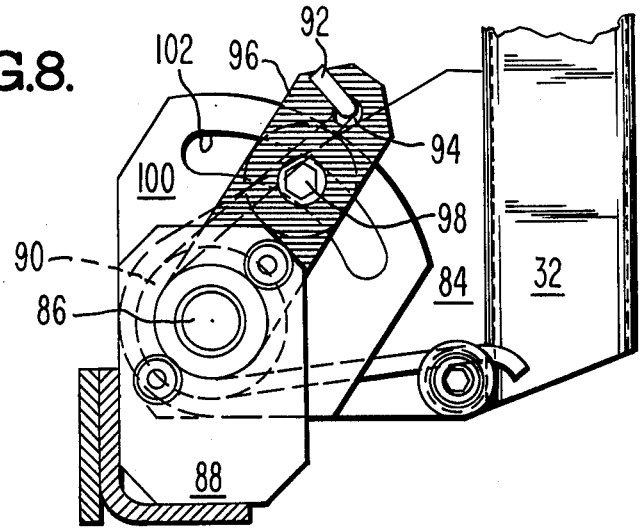
FIG. 8 is a further detail view of the spring biasing arrangement of the structure of FIG. 7.
Figure 9:
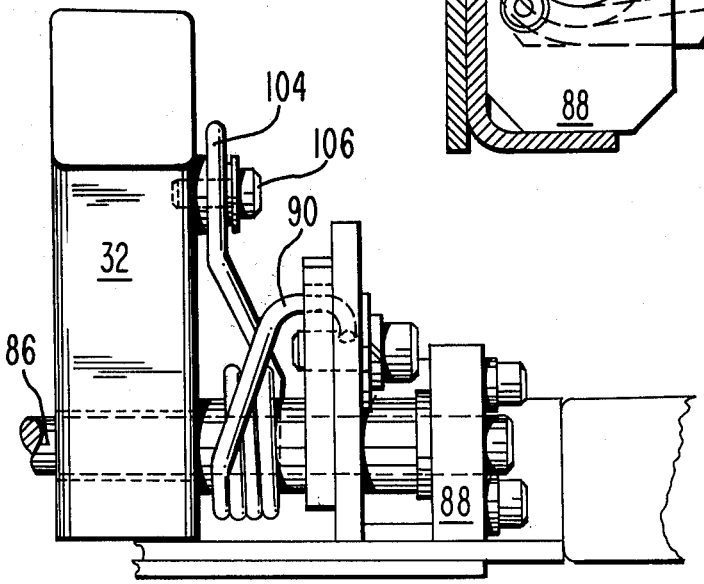
FIG. 9 is an additional detail view of the spring arrangement of FIG. 7.

The vertically extending bent post or pillar 32 FIGS. 1, 2 and 6 is constructed from a rigid U-shaped channel member and is arcuately, pivotally mounted at its base, as seen in FIGS. 7, 8 and 9, by means of an angle bracket 84 which is secured to the vertical pillar 32 and rockably supports the pillar on a cross shaft 86, the latter being supported on oppositely disposed, parallel, separated, upstanding standoff members 88, the latter being secured to the base of the frame of the apparatus, as by bolts.

A coiled torsion spring 90 surrounds the shaft 86 intermediate its ends. One end 92 is bent to penetrate hole 94, FIGS. 7 and 8, and to engage the rear of a pin holder 96 rockably mounted on shaft 86. A short stud 98 secures member 96 to support a spring tension adjustment 100 so that pin 98 is arcuately movable is curved slot 102 in member 100. The opposite end of coiled spring 90 is secured by an eye 104 formed therein to a short stud 106 projecting from movable pillar number 32. Arcuate movement of member 32 compresses spring 90 as member 32 is moved closer to the main tray of the apparatus. A micro switch 108, FIG. 7 interconnected to the electronic control circuitry (not shown), is secured to the left most standoff 88. The actuating arm or actuator 110 of switch 108 is engageable by the pillar 32 to open and close switch 108 as the pillar 32 is moved back and forth, for purposes still to be described herein.

As earlier mentioned, in connection with FIGS. 2 and 3, the reloader-elevator apparatus of the present invention provides means for automatically elevating a paper stack as the sheets of paper are fed therefrom by a feeder apparatus of the type described and claimed in earlier referenced co-pending U.S. patent application U.S. Ser. No. 240,898 assigned to the same assignee as the present invention.

Figure 12:
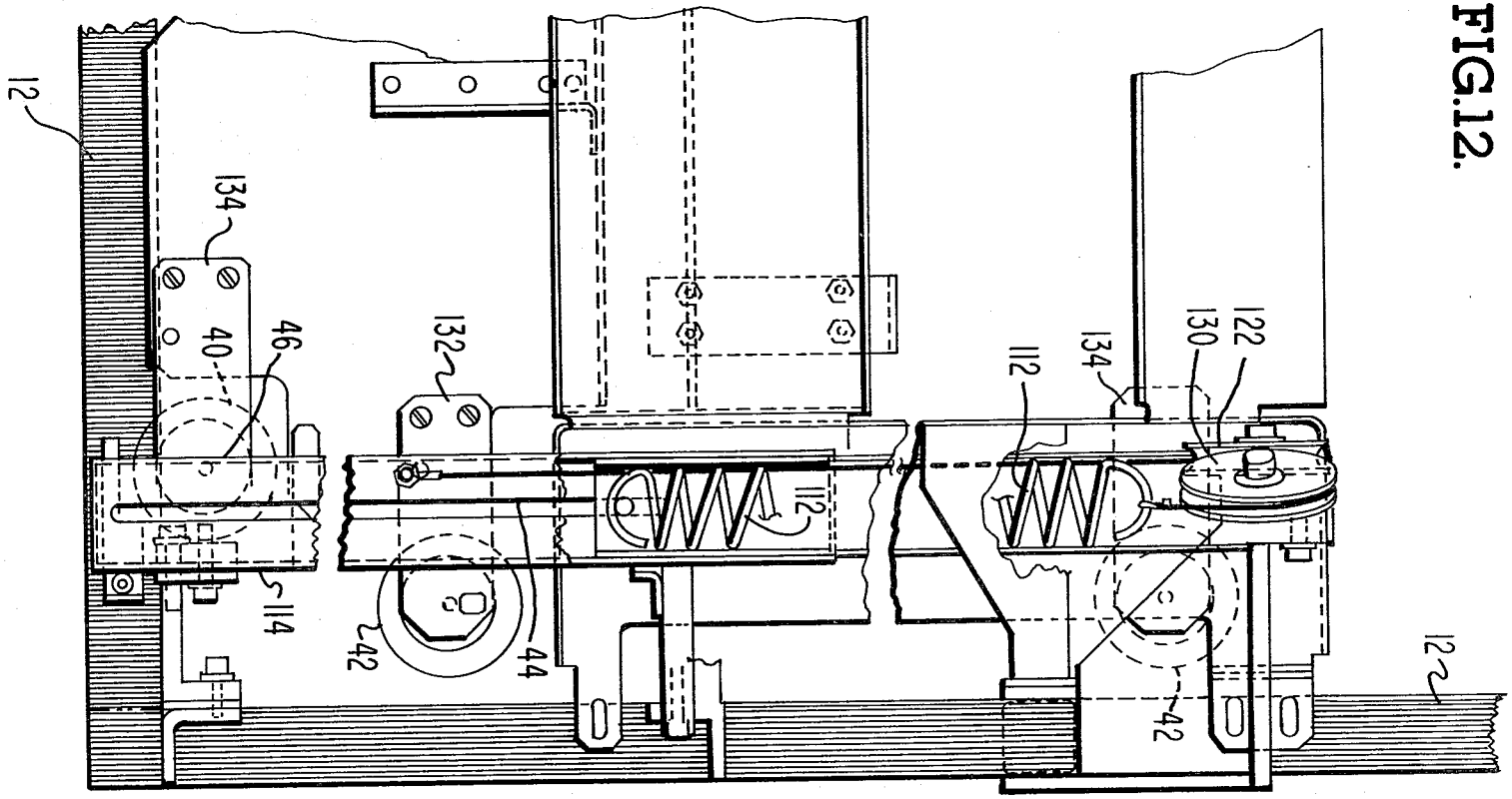
FIG. 12 is a side elevational view (with portions broken away) of the counter balancing mechanism for the elevator tray of the present invention.
Figure 13:
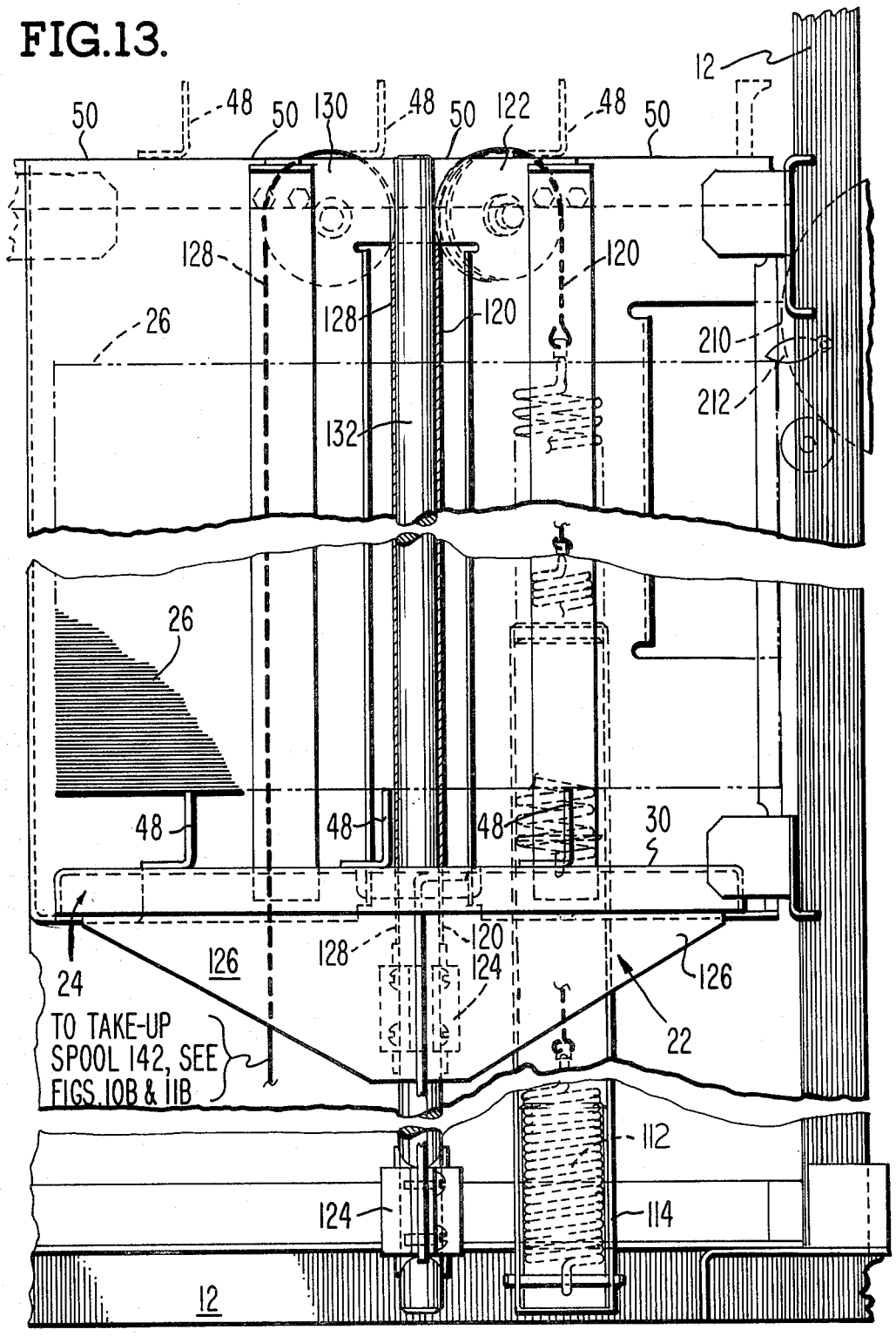
FIG. 13 is a front view of the mechanism of FIG. 12 illustrating the elevator tray in two positions as it is raised during feeding.

Because of the relatively heavy weight of the paper (e.g. multiple reams of 500 sheets) being employed with the present apparatus, the main paper feed tray 24 as seen in FIGS. 12 and 13 with its upstanding projections 48 is counter balanced by means of a relatively large coil spring 112. Spring 112 is, movably contained in an elongaged, hollow vertically slidably extending tubular member 114. One end of spring 112 is secured to a cross pin 119 horizontally disposed in the bottom of member 114. The opposite end of the coil spring is secured to a flexible wire cable 120. Cable 120 is adapted at the upper portion of the apparatus to pass over an angularly oriented guide pulley 122 after which it descends parallel with the spring to an attachment securing block 124 where it is secured against movement to the wedge shaped skirt member 126 secured to the bottom of main tray 24. A second cable 128 is attached to the opposite side of the mounting-securing block 124 and runs vertically upwardly over a second guide pulley 130 downwardly to be attached to the takeup spool (not shown) of the elevating drive apparatus 28, as will be described later on herein.

So as to ensure stable vertical up and down travel movement of the main tray 24 a vertical stabilizing column 46 as seen in FIGS. 1 and 12, extends from bottom to top of the main frame of the present apparatus. Oppositely disposed guide rollers 40 and 42 rotatably secured to the main tray as by standoff supports 132 and 134, respectively, are adapted to roll along the column 46 as the tray is raised and lowered, as will be described presently.

The main drive 28, shown schematically in FIG. 1, of the present invention is seen in the detail views of FIGS. 10*a*, 10*b*, 11*a* and 11*b* respectively, to comprise a main drive electric motor 136 FIGS. 10*a* and 11*a*, an electromagnetic clutch unit 138 and a solenoid controlled escapement 140 for actuating (i.e. rotating) a cable spool 142 and cable 128 for controlling the up and down movement of the main item tray 24, as will be described shortly.

Figures 10, 10A:
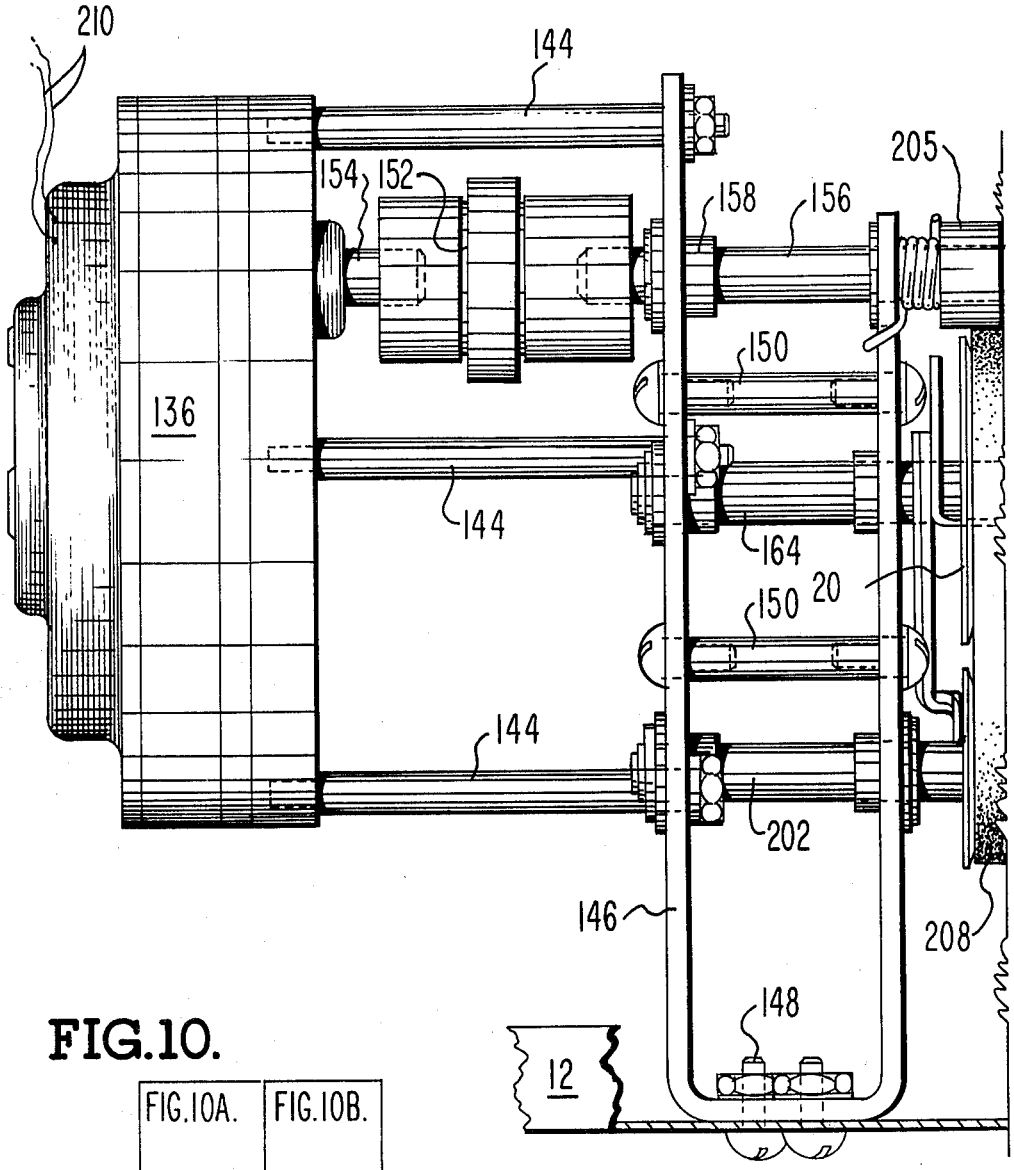
FIG. 10 is a plan view of the arrangement of FIGS. 10*a* and 10*b;*
FIGS. 10*a* and 10*b* together illustrate a side elevational view of the drive escapement mechanism and cable arrangement for moving the elevator tray up and down as the paper stack is advanced toward the feed head of the present invention.
Figure 10B:
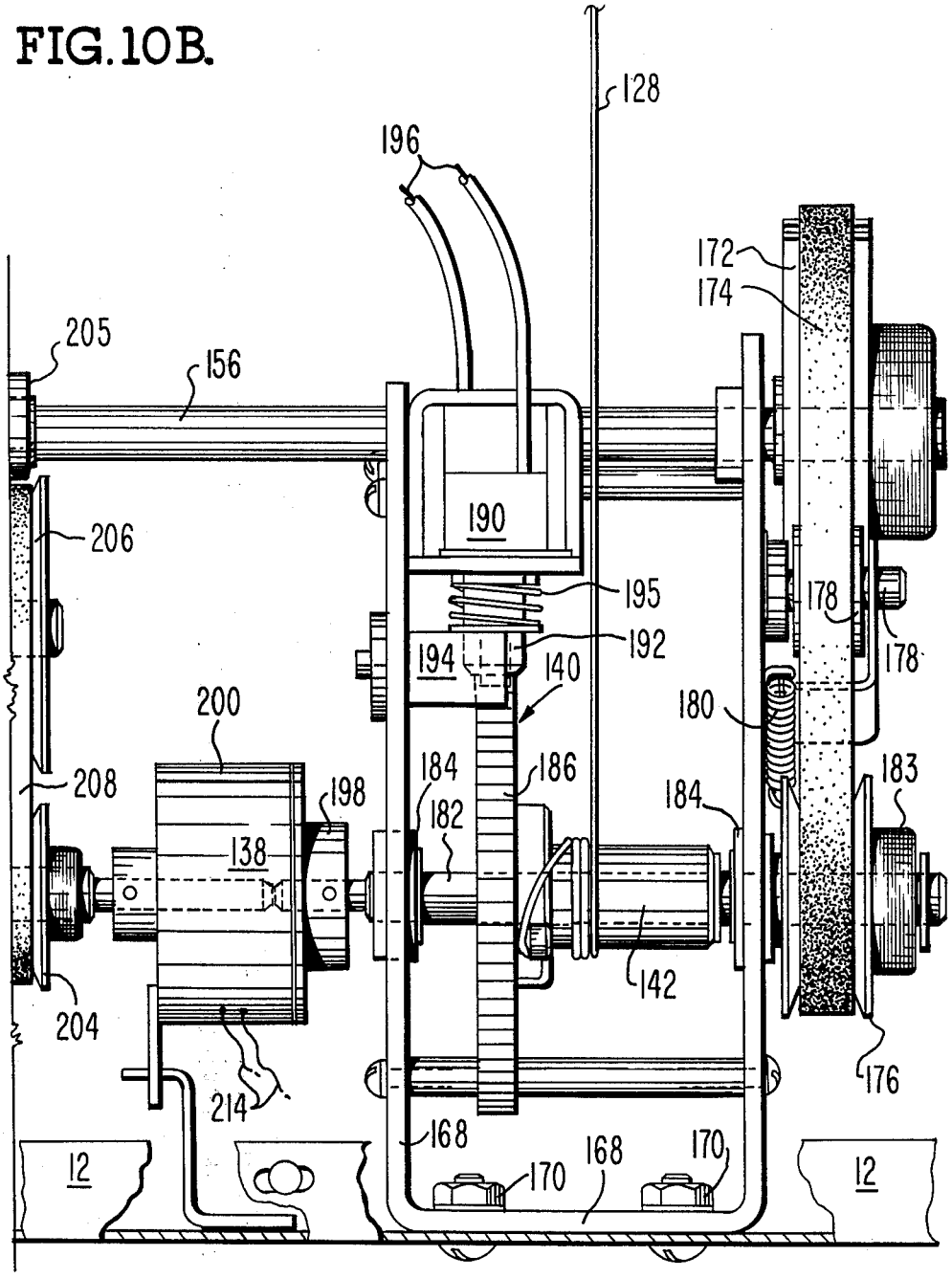
Figures 11, 11A:
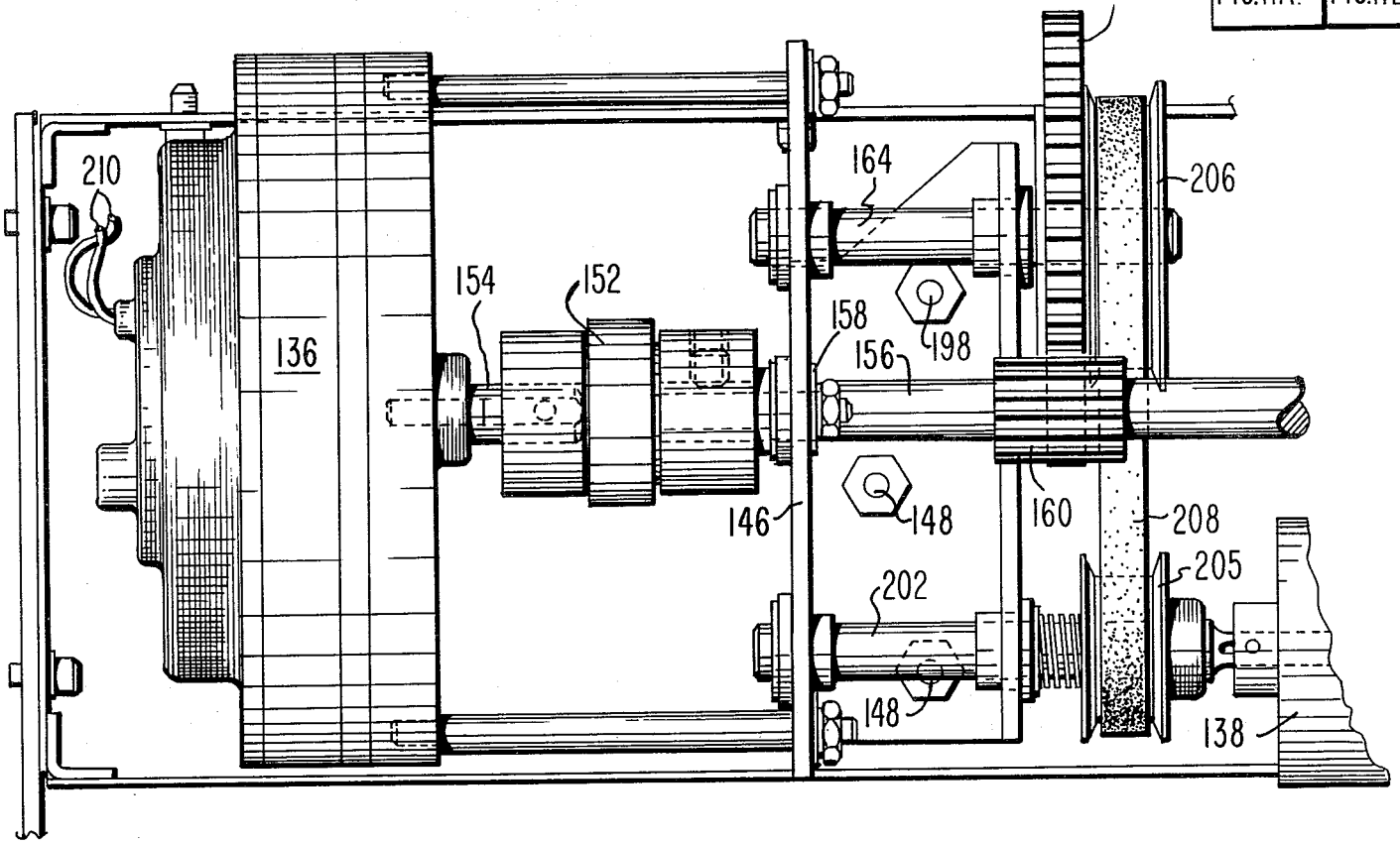
FIG. 11 is a plan view of the arrangement of FIGS. 11*a* and 11*b;*
FIGS. 11*a* and 11*b* together illustrate a top plan view of the drive mechanism of FIGS. 10*a* and 10*b;*

Referring to FIGS. 10*a* and 10*b*, 11*a* and 11*b* in more detail, it can be seen first in FIGS. 10*a* and 10*b* that electric drive motor 136 is supported in a horizontal attitude by means of horizontally disposed support rods 144 extending leftwardly from an upstanding U-shaped frame 146. Rods 144, at one end, are threaded into the frame or shell of motor 136 and are bolted to the frame 146 at their opposite ends. Frame 146 is secured to the base of the main apparatus, FIGS. 11*a*, by means of bolts 148. Strengthening spacers 150 maintain the upper portion of member 146 in substantially U-shape while aiding and regidifying the structure. A multi-part coupling 152 (FIG. 11*a*) inter-connects the output shaft 154 of motor 136 to elongated horizontal drive shaft 156. Drive shaft 156 is journaled at one end in bearings 158 in the left most vertical portion of U-frame 146. A pinion gear 160 is mounted intermediate the ends of shaft 156 and is disposed in driving engagement with take off gear 162 on cross shaft 164. The rightward end, FIGS. 10*b* and 11*b*, of shaft 156 is journaled in bearings 166 in the right hand, upstanding portion of U-frame 168, the latter being secured to the base apparatus by means of bolts 170.

Figure 11B:
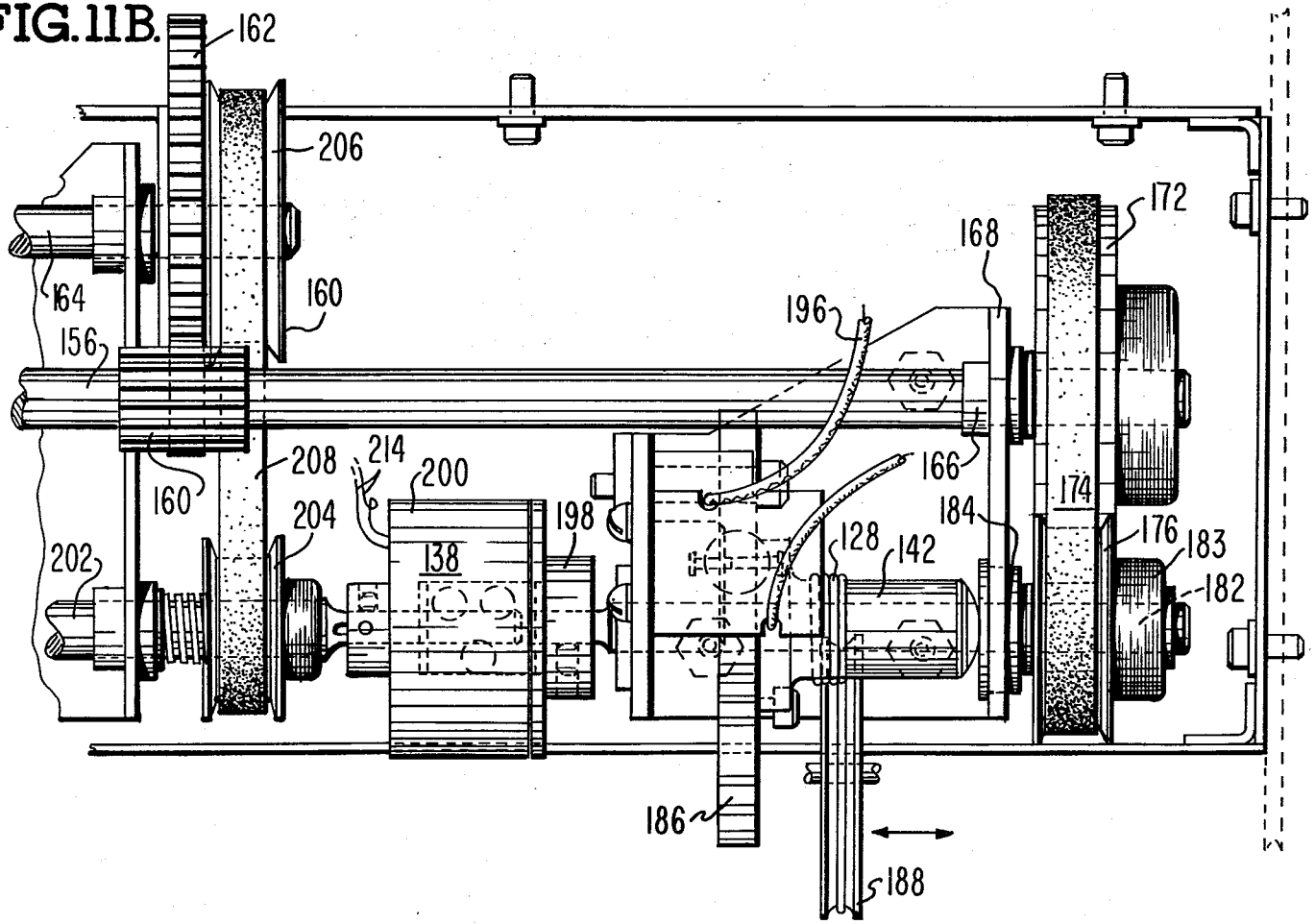

Secured to the outboard end of shaft 156 is a toothed drive pulley 172. A toothed belt 174 drivingly connects pulley 172 to toothed pulley 176. An idler pulley 178 FIG. 10*b*, biased by spring 180, applies suitable tension to belt 174 to maintain good driving connection between the two pulleys 172 and 176. Pulley 176 is mounted to and drives shaft 182. A one way, unidirectional clutch 183 permits this pulley to move in one direction only, as will be described later on herein. Shaft 182 extends leftwardly, FIGS. 10*b* and 11*b*, and is journaled in bearings 184 in both upstanding portions of U-frame 168. A large toothed, escapement wheel 186 is mounted for rotation on shaft 182. Cable spool or drum 142 is secured for rotation to shaft 182 and, as seen, carries the lower end of the hoisting cable 128. An outboard cable guide pulley 188 movable in the direction of the two headed arrow is employed to ensure that the cable turns are overlayed in even fashion on cable drum 142 as the drum revolves. Solenoid escapement 140 includes (as seen in FIGS. 10*b* and 11*b*) a solenoid 190, the depending plunger 192 of which rockably engages an escapement pawl 194 with the teeth of escapement wheel 186. A spring 195 biases the pawl 194 toward the wheel 186 so that in the deactivated condition the pawl 194 locks the wheel in position preventing up and down movement of main item tray 24. Solenoid 190 is energized over leads 196.

Pinned to the leftward end of shaft 182 (FIGS. 10*b* and 11*b*) is the output portion 198 of an electromagnetic clutch 138. The input portion 200 of clutch 138 is secured to cross shaft 202 journaled in U-frame 146. Driven pulley 204 on shaft 202 (FIG. 10*b* only) derives its rotative input from drive pully 206 to which it is coupled by grooved belt 208 over spring biased idler pulley 205 (FIGS. 10*a* and 11*a*) through shaft 156 by means of drive gear 162 and pinion gear 160. Drive motor 136, energized over lead 210, is adapted to be continuously running, for purposes to be explained presently.

OPERATION

Assume that the apparatus has been operating for a time and the last sheet of paper 26 has been fed by the feed wheel 210 into the associated apparatus. End of paper switch 212 (FIG. 1) drops downwardly contacting the main item paper drive tray 24. The signal generated by this switch closure over lines 214 FIGS. 10*b* and 11*b* causes electromagnetic clutch 138 to engage. Clutch engagement causes the output drive through pulley 206, belt 160 and pulley 204 to rotate main shaft 202 and shaft 182 effectively rotating cable drum 142, winding cable 128, elevating the main item tray 24. The forward rotation of escapement wheel 186 causes the ratchet pawl 194 to ratchet idly over the teeth of the wheel 186.

The main item tray 24 continues upwardly, pushing the rockably pivoted feed wheel assembly 210 arcuately, out of the way of the tray 24 to a position where the feed wheel is locked by a solenoid actuated link (not shown) but similar to that shown, described and claimed in co-pending U.S. patent application U.S. Ser. No. 240,898 filed Mar. 5, 1981 in the names of William F. Voecks, Jr. and Richard E. Shultz, entitled PIVOTAL FEED HEAD FOR PRINTING APPARATUS and assigned to the same assignee as the present invention now abandoned in favor of Continuation-In-Part U.S. Ser. No. 481,036.

The main item tray 24 continues its upward travel to a position where it intercepts the reload tray 30. It is noted that the reload tray 30 has been moved (by the operator) from the full line position (left in FIG. 1) to the dotted line position (rightward in FIG. 1) and has been provided with a fresh stack of paper 26*a*. The fingers 50 of the reload tray are now nested with the upstanding members 48 of the main item tray 24, FIGS. 2 and 3, and the reload tray latch 56 has seated against the reload tray latch pin 54, FIG. 5.

Figure 5:
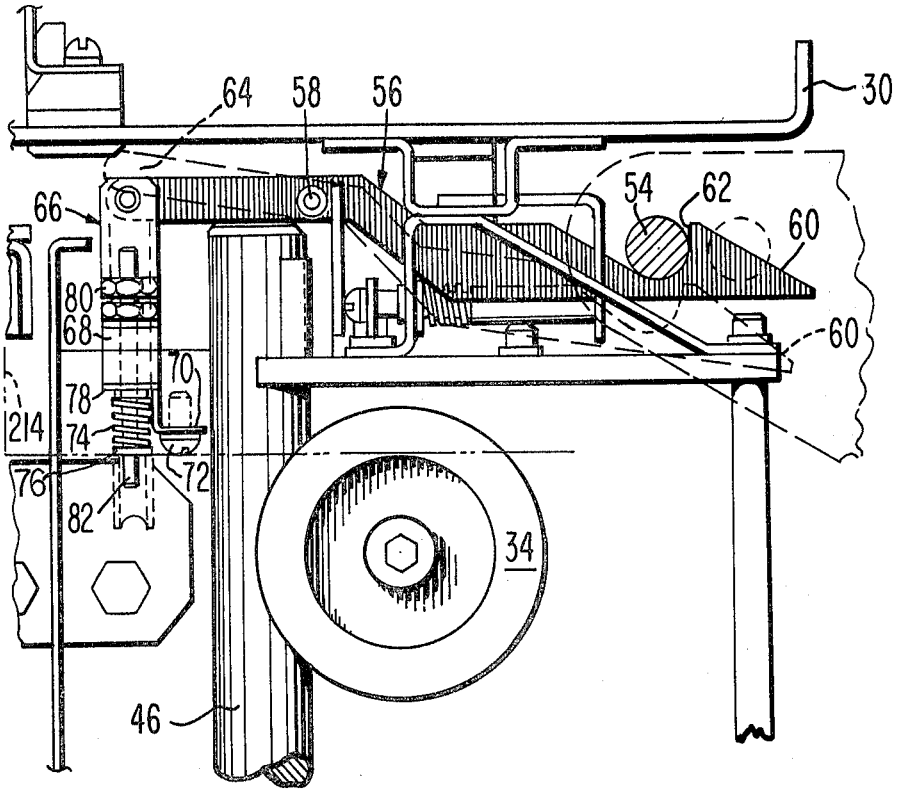
FIG. 5 is a detail side view of the latching mechanism illustrated in the latched position.

Continued upward movement of the now empty main item tray 24 carries the upstanding projections 48 into a position to raise the paper stack 26*a* off of the reload tray 30 freeing the reload tray. As seen in FIG. 5, release of reload tray 30 is accomplished by means of the inboard edge 214 of main item tray 24 which now engages and lifts tab member 76 on the bottom of member 66 rocking the latch link 56 arcuately about pivot 58 from the full (lock) to the dotted (release) position. This action permits the reload tray 30 to be snapped backwardly (leftwardly FIG. 1) by spring 90, FIG. 7, out of the way of the main item tray 24. As the reload tray 30 moves rearwardly microswitch 108 opens which in turn causes the electromagnetic clutch 138 to disengage. This causes the main tray 24 to start to drop. However, spring biased pawl 194 immediately engages ratchet wheel 186 stopping tray 24.

As the reload tray 30 reaches its rear most position in the backward travel the micro switch 108, FIG. 7, on the bottom of the pillar 32 produces a closure signal which is forwarded to the electronics hardware (not shown) indicating that the main item tray is now ready to be lowered for operational feeding. This signal is sent to the electromagnetic clutch 138 (over lines 214) for a brief instant but of sufficient duration to permit the clutch to engage and the main drive to rotate far enough to take the pressure off the pawl 194. A signal to the solenoid 190 over lines 196 pulls in the plunger 192 lifting the pawl 194 from the teeth of the escapement wheel 186. The clutch is immediately disengaged after which, due to its weight, the paper and the tray 24 start to fall. The one way clutch 183 on the spool shaft 182 now comes into play. As the paper tray tries to overrun the speed of the drive motor 136, the one way clutch binds and forces the tray to move at whatever speed the one way clutch assembly is moving.

At this juncture the counter weight spring 112 counter balances the tray and paper. The paper tray 24 continues its downward movement. Since it isn't deemed practical to place a sensor on the bottom of the spring assembly to indicate that the tray has moved all the way to the bottom of its travel, present system utilizes a timing interval to provide a signal to engage the clutch and drive the paper tray upwardly once more for feeding. Once the electronics (not shown) has timed out the movement of the main item tray, it assumes that it has made the complete excursion to the lower most point of its downward travel. The software of the system (not shown) signals the feed wheel release solenoid (not shown) to release the feed wheel 210. The feed wheel drops down into feeding position, FIG. 1. At this point it contacts a paper height sensor (not shown) which indicates that the paper is too low for feeding. A signal is then sent to the main drive electromagnetic cluch over lines 214 causing the clutch to engage enabling the takeup spool to rotate and wind the cable there around causing the main item tray 24 to start its transition upwardly. As the point is reached where the tray is to stop its upward travel a signal is sent to the electromagnetic clutch which disengages the clutch and stops the upward movement of the tray. The tray would otherwise tend to immediately fall but the spring biased solenoid pawl immediately engages the ratchet wheel and locks the ratchet wheel in position. Thus, the cable winding spool cannot thereafter unwind.

As the paper stack on the main item tray 24 now reaches the point where the upper most sheet engages the feed wheel the upward movement of the tray is stopped. The software and electronics of the main apparatus initiate feeding. The feed wheel 210 is rotated and the sheets are fed sequentially one after the other from the top of the stack into the copying device to which the present apparatus is operationally interconnected.

What is claimed is:

1. Modular automatic reloader-elevator for cut sheet printing/copying apparatus wherein individual sheets of paper are fed from a stack to a feeding device and wherein fresh sheets are automatically reloaded momentarily interrupting the operation of the apparatus, comprising, a main item feeding tray centrally, vertically, cantilever mounted for movement relative to a base support member, drive means for raising and lowering said feeding tray on demand along a vertical guide relative to said base support member;

means for sensing when said tray is exhausted of paper items;

an item reloader tray arcuately, pivotally mounted so as to be movable normal to and into and out of the path of movement of said main item tray;

means for temporarily locking said item reloader tray in position in the path of movement of said main item tray so that said main item tray can engage said reloader tray for loading of items therefrom, and means responsive to said sensing means for energizing said drive means effectively raising said main item tray into engagement with said reloader tray thereby unlocking said reloader tray and causing the paper items on said paper reloader tray to seat upon said main item tray simultaneously moving said reloader tray out of the path of movement of said main item tray enabling the item feeding to resume.

2. The invention in accordance with claim 1 wherein said means for sensing the exhaustion of paper on said main item tray comprises a micro switch including a switch actuating arm engageable with said main item tray.

3. The invention in accordance with claim 1 wherein said item reloader tray further comprises a member pivoted at its base and biased away from said main item tray and supporting a flat, slotted member movable along a support rail effective when moved towards said main item tray to load paper items from said reloader tray onto said main item tray.

4. The invention in accordance with claim 1 wherein said locking means comprises a pivotal link and operably associated release means and wherein said reloader tray is provided with means engaging said link for locking said reloader tray to said base such that upward movement of said main item tray engages said release means effective to move said reloader tray out of the path of movement of said main item tray for continuous item feeding.

5. The invention in accordance with claim 1 further including a first means engageable with said main item tray for counter balancing the weight of the items transferred from said reloader tray to said main item tray and a second parallel means engageable with said main item tray and said drive means for elevating said main item tray into feeding position against the weight of said counter balancing means.

6. The invention in accordance with claim 1 wherein said main item tray includes a plurality of item supporting upstanding lands or projections and wherein said reloader tray incudes an equal number of grooves or slots, the projections of said main item tray being receivable within the slots of said reloader tray when said reloader tray is moved into the path of movement of said main item tray and said main item tray is elevated into engagement with said reloader tray for automatic item reloading.

7. The invention in accordance with claim 6 including means preventing jamming in said reloader tray comprising a cross guard member including means interfitting with the grooves in said reloader tray.

* * * * *